US006604367B2

(12) United States Patent
Ahmed et al.

(10) Patent No.: US 6,604,367 B2
(45) Date of Patent: Aug. 12, 2003

(54) SYSTEM FOR PROVIDING REFRIGERATION FOR CHEMICAL PROCESSING

(75) Inventors: M. Mushtaq Ahmed, Pittsford, NY (US); Theodore Fringelin Fisher, West Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/021,352

(22) Filed: Dec. 19, 2001

(65) Prior Publication Data

US 2003/0110782 A1 Jun. 19, 2003

(51) Int. Cl.[7] ..... F25B 47/00

(52) U.S. Cl. ..... 62/85; 62/94; 62/112; 62/401

(58) Field of Search ..... 62/85, 86, 94, 62/112, 114, 172, 401, 402, 476, 636

(56) References Cited

U.S. PATENT DOCUMENTS

| | | | | | |
|---|---|---|---|---|---|
| 3,872,682 | A | | 3/1975 | Shook | 62/114 |
| 3,889,485 | A | * | 6/1975 | Swearingen | 62/54 |
| 4,116,017 | A | | 9/1978 | Oberpriller | 62/62 |
| 4,607,489 | A | | 8/1986 | Krongold | 62/49 |
| 4,914,166 | A | | 4/1990 | Kennedy et al. | 526/61 |
| 5,317,904 | A | * | 6/1994 | Bronicki | 62/87 |
| 5,394,827 | A | | 3/1995 | Cheng | 117/206 |
| 5,473,900 | A | * | 12/1995 | Low | 62/9 |
| 5,483,806 | A | | 1/1996 | Miller et al. | 62/402 |
| 5,524,442 | A | * | 6/1996 | Bergman, Jr. et al. | 62/86 |
| 5,566,554 | A | * | 10/1996 | Vijayaraghavan et al. | 62/621 |
| 5,718,116 | A | | 2/1998 | Grassi et al. | 62/62 |
| 5,943,869 | A | | 8/1999 | Cheng et al. | 62/121 |
| 5,950,453 | A | | 9/1999 | Bowen et al. | 62/612 |
| 6,250,096 | B1 | | 6/2001 | Bonaquist et al. | 62/401 |
| 6,276,167 | B1 | * | 8/2001 | McCaulley | 62/619 |
| 6,301,923 | B1 | | 10/2001 | Bonaquist et al. | 62/402 |
| 6,336,334 | B1 | * | 1/2002 | Minkkinen et al. | 62/123 |
| 6,415,628 | B1 | * | 7/2002 | Ahmed et al. | 62/534 |

* cited by examiner

*Primary Examiner*—Melvin Jones
(74) *Attorney, Agent, or Firm*—Stanley Ktorides

(57) ABSTRACT

A system for providing refrigeration to a chemical processing operation wherein a refrigerant fluid is compressed and cooled, and a portion turboexpanded prior to being passed to a chemical processing operation for direct contact or indirect heat exchange.

14 Claims, 2 Drawing Sheets

SYSTEM FOR PROVIDING REFRIGERATION FOR CHEMICAL PROCESSING

TECHNICAL FIELD

This invention relates generally to the provision of refrigeration for use in a chemical processing operation.

BACKGROUND ART

Refrigeration is widely required for use in chemical processing operations such as for use in cooling of exothermic reactors and for use in the cooling of crystallizers. The refrigeration may be provided to the chemical processing operation by indirect heat exchange or by direct contact heat exchange. The provision of refrigeration is costly and any improvement in the provision of refrigeration to a chemical processing operation is very desirable. In particular, often in chemical processing, refrigeration is desired at more than one temperature and a system which can better provide refrigeration to a chemical processing operation at more than a single temperature would be very advantageous.

Accordingly, it is an object of this invention to provide an improved system for providing refrigeration to a chemical processing operation.

SUMMARY OF THE INVENTION

The above and other objects, which will become apparent to those skilled in the art upon a reading of this disclosure, are attained by the present invention, one aspect of which is:

A method for providing refrigeration for chemical processing:

(A) compressing a refrigerant fluid to produce compressed refrigerant fluid;

(B) cooling a first portion of the compressed refrigerant fluid and passing the cooled first portion of the refrigerant fluid to a chemical processing operation to provide cooling for the chemical processing operation;

(C) cooling a second portion of the compressed refrigerant fluid, turboexpanding the cooled second portion of the refrigerant fluid, and passing the turboexpanded second portion of the refrigerant fluid to the chemical processing operation to provide cooling for the chemical processing operation; and (D) withdrawing refrigerant fluid from the chemical processing operation and passing refrigerant fluid withdrawn from the chemical processing operation in indirect heat exchange with at least one of the cooling first portion of the compressed refrigerant fluid and the cooling second portion of the compressed refrigerant fluid.

Another aspect of the invention is:

Apparatus for providing refrigeration for chemical processing comprising:

(A) a compressor, a heat exchanger, and means for passing a first refrigerant fluid stream from the compressor to the heat exchanger;

(B) a turboexpander, means for passing a second refrigerant fluid stream from the compressor to the heat exchanger, and means for passing the second refrigerant fluid stream from the heat exchanger to the turboexpander;

(C) a chemical processing operation, means for passing the first refrigerant fluid stream from the heat exchanger to the chemical processing operation, and means for passing the second refrigerant fluid stream from the turboexpander to the chemical processing operation; and (D) means for passing refrigerant fluid from the chemical processing operation to the heat exchanger.

DETAILED DESCRIPTION

Figure 1:
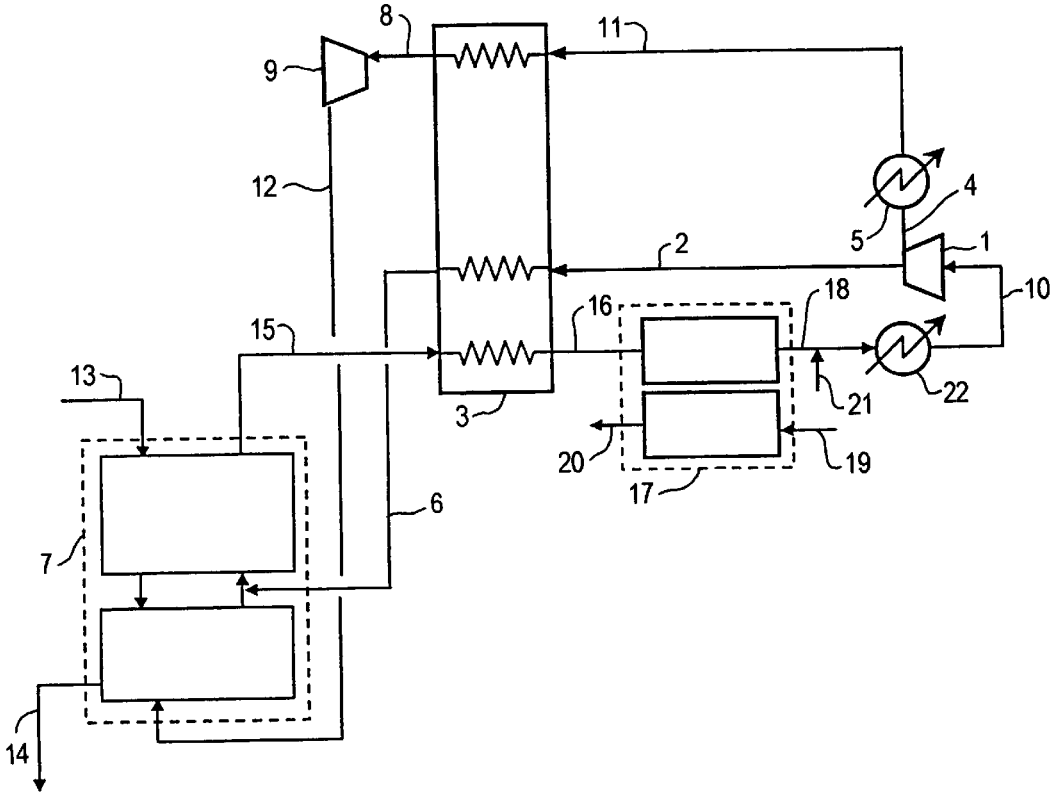
FIG. 1 is a schematic representation of one preferred embodiment of the refrigeration system of this invention.

The invention will be described in detail with reference to the Drawings. Referring now to FIG. 1, refrigerant fluid 10 is compressed by passage through compressor 1 to a pressure generally within the range of from 200 to 600 pounds per square inch absolute (psia). The refrigerant fluid may comprise a single component or may comprise more than one component. When the refrigeration is provided to the chemical processing operation by direct contact heat exchange, it is preferred that the refrigerant fluid is composed of a component or components which are substantially inert relative to the chemical processing operation. A preferred refrigerant fluid for use in the practice of this invention comprises nitrogen or a mixture of nitrogen with one or more other components. Other refrigerant fluids which may be used in the practice of this invention include fluids containing one or more hydrocarbons, fluids containing one or more fluorocarbons, and fluids containing one or more noble gases.

A first portion 2 of the compressed refrigerant fluid is passed to heat exchanger 3 wherein it is cooled by indirect heat exchanger with a return stream as will be more fully described below. Preferably, as illustrated in the Drawings, heat exchanger 3 is a unitary piece. Alternatively heat exchanger 3 could comprise more than one piece or module. A second portion 4 of the compressed refrigerant fluid is cooled of the heat of compression by passage through cooler 5 and then passed as stream 11 to heat exchanger 3 wherein it is cooled by indirect heat exchange with a return stream.

The cooled first portion 6 of the compressed refrigerant fluid is passed from heat exchanger 3 to chemical processing operation 7 wherein it serves to provide refrigeration or cooling for the chemical processing operation. Chemical processing operation 7 could be any process that requires cooling or refrigeration such as a reactor housing an exothermic chemical reaction, or a crystallization process using a crystallizer such as a paraxylene crystallization process. Other examples of chemical processing operation 7 include a separation process using a condensation device to condense out hydrocarbons from a gas mixture, and a process to cool intermediate heat transfer media such as solids or high boiling point liquids.

The cooled second portion 8 of the compressed refrigerant fluid is passed to turboexpander 9 wherein it is turboexpanded to generate refrigeration. Resulting turboexpanded second portion 12 is then passed to chemical processing operation 7 to provide cooling for the chemical processing operation. The second portion 12 of the refrigerant fluid provided to chemical processing operation 7 will be at a colder temperature than the first portion 6 of the refrigerant fluid provided to chemical processing operation 7. In addition, stream 12 will be at a temperature of at least 40 K, preferably at least 100 K, less than the temperature of stream 15 returning from chemical processing operation 7.

The provision of refrigeration or cooling to the chemical processing operation 7 by the refrigerant fluid streams 6 and 12 can be by indirect heat exchange or by direct contact heat exchange. The embodiment illustrated in FIG. 1 is a direct contact heat exchange arrangement wherein the refrigerant fluid directly contacts a heat source and consequently becomes contaminated. In the embodiment illustrated in FIG. 1 the heat source is illustrated by input 13 which receives refrigeration by direct contact with refrigerant from streams 6 and 12, resulting in refrigerated fluid or other substance 14. The heat source is also a source of contaminants for the refrigerant fluid. Refrigerant fluid 15 leaves process or system 7 as a vapor containing one or more contaminants such as chemical species which it picks up as a result of directly contacting heat source 13. For example in a paraxylene crystallization process, the contaminants in stream 15 may include input 13 constituents such as paraxylene, metaxylene, orthoxylene and ethylbenzene.

Contaminant containing refrigerant fluid 15 is passed to heat exchanger 3 wherein it is warmed by indirect heat exchange with the cooling refrigerant fluid in streams 2 and 11 as was previously described, and the resulting warmed contaminant containing refrigerant fluid 16 is cleaned of contaminants in a cleaning device. The embodiment of the invention illustrated in FIG. 1 is a preferred embodiment wherein the cleaning device is an adsorption unit and the contaminant containing refrigerant fluid is cleaned of contaminants by passage through one of two beds of adsorption system 17. The beds contain suitable adsorbent material such as zeolite molecular sieve to remove contaminants by adsorption onto the adsorbent as the direct contact refrigerant passes through the bed, emerging therefrom as clean refrigerant fluid 18. When the adsorbent bed becomes loaded with contaminants the flow of contaminant containing refrigerant fluid is directed into the other bed while the loaded bed is cleaned by the passage therethrough of purge gas, shown in FIG. 1 as streams 19 and 20. This continues until the adsorbing bed becomes loaded with contaminants whereupon the flows are changed again. The adsorption system continues cycling in this manner.

If desired, make-up refrigerant fluid 21 may be added to clean refrigerant 18 to make up for the loss of refrigerant in the direct contacting of the heat source. The clean refrigerant fluid is cooled in cooler 22 and passed in stream 10 to compressor 1 and the refrigeration cycle starts anew.

Figure 2:
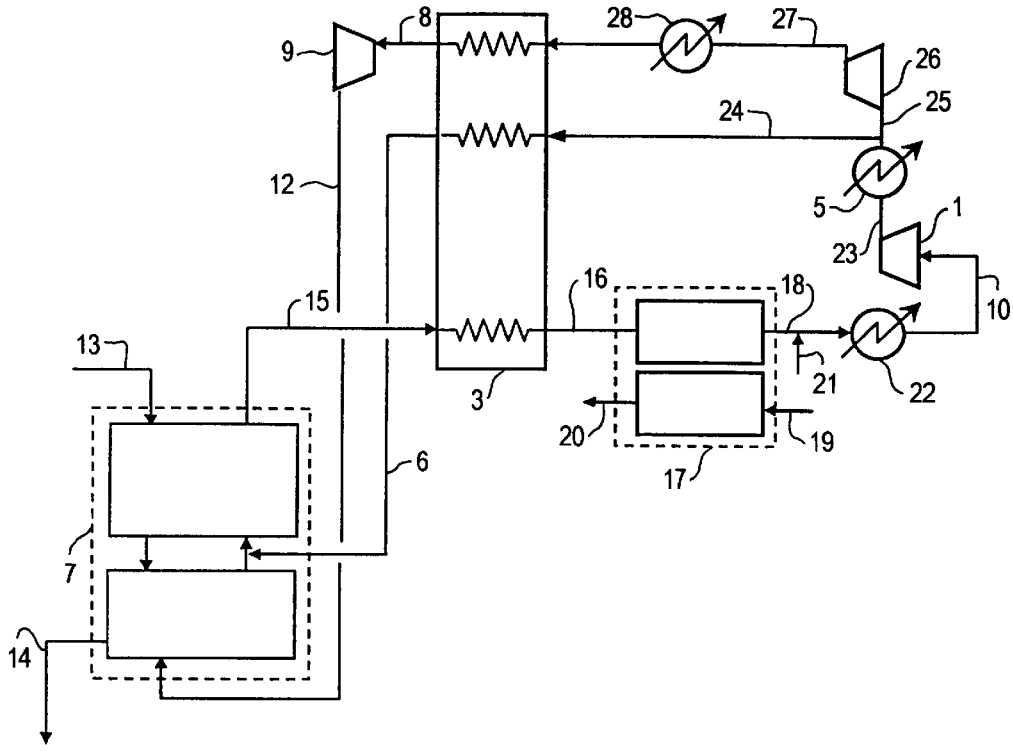
FIG. 2 is a schematic representation of another preferred embodiment of the refrigeration system of this invention employing further compression of the stream directed to the turboexpander.

FIG. 2 illustrates another embodiment of the invention. The numerals of FIG. 2 are the same as those of FIG. 1 for the common elements, and these common elements will not be described again in detail.

Referring now to FIG. 2, the entire output from compressor 1 is passed as compressed refrigerant fluid 23 to cooler 5 prior to being divided into a first portion and a second portion. First portion 24 is then passed from cooler 5 to heat exchanger 3. Second portion 25 is passed from cooler 5 to second or auxiliary compressor 26 wherein it is compressed to a higher pressure generally within the range of from 400 to 650 psia. Resulting boosted refrigerant fluid second portion 27 is cooled of the heat of compression in cooler 28 and then passed as stream 29 to heat exchanger 3. The remainder of the system illustrated in FIG. 2 is similar to the embodiment illustrated in FIG. 1.

Although the invention has been described in detail with reference to certain preferred embodiments, those skilled in the art will recognize that there are other embodiments of the invention within the spirit and the scope of the claims.

What is claimed is:

1. Apparatus for providing refrigeration for chemical processing comprising:

(A) a compressor, a heat exchanger, and means for passing a first refrigerant fluid stream from the compressor to the heat exchanger;

(B) a turboexpander, means for passing a second refrigerant fluid stream from the compressor to the heat exchanger, and means for passing the second refrigerant fluid stream from the heat exchanger to the turboexpander;

(C) a chemical processing operation, means for passing the first refrigerant fluid stream from the heat exchanger to the chemical processing operation, and means for passing the second refrigerant fluid stream from the turboexpander to the chemical processing operation; and (D) means for passing refrigerant fluid from the chemical processing operation to the heat exchanger.

2. The apparatus of claim 1 wherein the means for passing the second refrigerant fluid from the compressor to the heat exchanger includes an auxiliary compressor.

3. The apparatus of claim 1 wherein the heat exchanger is a unitary piece.

4. The apparatus of claim 1 further comprising a cleaning unit, means for passing refrigerant fluid from the heat exchanger to the cleaning unit, and means for passing refrigerant fluid from the cleaning unit to the compressor.

5. The apparatus of claim 1 wherein the chemical processing operation comprises a crystallizer.

6. The apparatus of claim 1 wherein the chemical processing operation comprises a condensation device.

7. The apparatus of claim 1 wherein the chemical processing operation comprises an exothermic reactor.

8. A method for providing refrigeration for chemical processing:

(A) compressing a refrigerant fluid to produce compressed refrigerant fluid;

(B) cooling a first portion of the compressed refrigerant fluid and passing the cooled first portion of the refrigerant fluid to a chemical processing operation to provide cooling for the chemical processing operation;

(C) cooling a second portion of the compressed refrigerant fluid, turboexpanding the cooled second portion of the refrigerant fluid, and passing the turboexpanded second portion of the refrigerant fluid to the chemical processing operation to provide cooling for the chemical processing operation; and (D) withdrawing refrigerant fluid from the chemical processing operation and passing refrigerant fluid withdrawn from the chemical processing operation in indirect heat exchange with at least one of the cooling first portion of the compressed refrigerant fluid and the cooling second portion of the compressed refrigerant fluid.

9. The method of claim 8 wherein the second portion of the compressed refrigerant fluid is further compressed prior to being turboexpanded.

10. The method of claim 8 wherein the first portion of the refrigerant fluid and the second portion of the refrigerant fluid provide cooling to the chemical processing operation by direct contact heat exchange.

11. The method of claim 10 wherein the refrigerant fluid withdrawn from the chemical processing operation contains contaminants, and further comprising cleaning the contaminant containing refrigerant fluid of contaminants and recycling the resulting clean refrigerant fluid for the compression to produce the compressed refrigerant fluid.

12. The method of claim 8 wherein the turboexpanded second portion of the refrigerant fluid is at a temperature which is less than the temperature of the cooled first portion of the refrigerant fluid.

13. The method of claim 8 wherein the turboexpanded second portion of the refrigerant fluid is at a temperature of at least 40K less than the temperature of the refrigerant fluid withdrawn from the chemical processing operation.

14. The method of claim 8 wherein the refrigerant fluid comprises nitrogen.

* * * * *